US007573431B2

(12) United States Patent
Parsche

(10) Patent No.: US 7,573,431 B2
(45) Date of Patent: Aug. 11, 2009

(54) BROADBAND POLARIZED ANTENNA INCLUDING MAGNETODIELECTRIC MATERIAL, ISOIMPEDANCE LOADING, AND ASSOCIATED METHODS

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 89 days.

(21) Appl. No.: 11/352,888

(22) Filed: Feb. 13, 2006

(65) Prior Publication Data

US 2007/0188397 A1 Aug. 16, 2007

(51) Int. Cl.
*H01Q 7/06* (2006.01)

(52) U.S. Cl. ..... 343/788; 343/873

(58) Field of Classification Search ..... 343/788, 343/841, 842, 909, 872, 873
See application file for complete search history.

(56) References Cited

U.S. PATENT DOCUMENTS 2,179,257 A * 11/1939 Goloviznin ..... 336/205
3,719,950 A * 3/1973 Bukhman et al. ..... 343/788
4,048,280 A 9/1977 Borzyak et al. ..... 264/102
4,184,972 A 1/1980 Pevzner et al. ..... 252/62.54
4,429,314 A * 1/1984 Albright ..... 343/788
5,817,250 A 10/1998 Mauczok et al. ..... 252/62.51
6,033,782 A * 3/2000 Hubbard et al. ..... 428/407
6,063,511 A * 5/2000 Purinton et al. ..... 428/800
6,117,517 A * 9/2000 Diaz et al. ..... 428/102
6,440,244 B1 8/2002 Diaz et al. ..... 156/93
6,441,771 B1 8/2002 Victora ..... 342/1

OTHER PUBLICATIONS

L.J. Chu, "Physical Limitations in Omnidirectional Antennas", Appl. Phys, 1948, 19, pp. 1163-1175.
Jasik et al., "Antenna Engineering Handbook", 1st ed., p. 17-9, 1961.
Wheeler, H.A., "A Helical Antenna For Circular Polarization", IRE Proc., vol. 35, Dec. 1947, pp. 1484-1488.
Maxwell, J.E., "Electricity and Magnetism", Oxford University Press, 3rd edition, vol. 2, 1892, pp. 304-308.
Wheeler, H.A., "The Spherical Coil as an Inductor, Shield, or Antenna", IRE Proc., vol. 46, Sep. 1958, pp. 1595-1602 & Errata, vol. 48, Mar. 1960, p. 328.
Wheeler, H.A., "The Radiansphere Around A Small Antenna", Proceedings of the IRE, Aug. 1959.

* cited by examiner

*Primary Examiner*—Michael C Wimer
(74) *Attorney, Agent, or Firm*—Allen, Dyer, Doppelt, Milbrath & Gilchrist, P.A.

(57) ABSTRACT

The broadband small antenna has equal magnetic electric proportions, circular polarization, and an isoimpedance magnetodielectric ($\mu_r \equiv \epsilon_r$) shell for controlled wave expansion. The shell is a radome without bandwidth limitation, with reflectionless boundary conditions to free space, providing loading and broad bandwidth antenna size miniaturization. The system is spherically structured based upon size, quality (Q) and bandwidth.

29 Claims, 3 Drawing Sheets

BROADBAND POLARIZED ANTENNA INCLUDING MAGNETODIELECTRIC MATERIAL, ISOIMPEDANCE LOADING, AND ASSOCIATED METHODS

FIELD OF THE INVENTION

The present invention relates to the field of communications, and more particularly, to antennas, and related methods.

BACKGROUND OF THE INVENTION

In antennas, size dictates bandwidth because field expansion occurs at a finite rate, given by the speed of light. This gives rise to the well known size-bandwidth limitation known as Chu's limit (CHU, L. J.: "Physical Limitations In Omnidireactional Antennas", J Appl. Phys, 1948, 19, pp. 1163-1175).

Newer designs and manufacturing techniques have driven electronic components to small dimensions and miniaturized many communication devices and systems. Unfortunately, antennas have not been reduced in size at a comparative level and often are one of the larger components used in a smaller communications device. To reduce antenna size, relative to free space wavelength, loading is typically used. Loading may take various forms, including, circuit loading and material loading.

In dielectric material loading, an antenna may be placed in proximity with dielectric compounds. For example, a thin wire dipole may be cast into a cake of paraffin. Or, a dielectric puck may be placed along a slot antenna, such as a planar inverted F (PIFA) antenna.

In magnetic material loading, an antenna is used in proximity with permeable magnetic compounds. An example is the "ferrite loopstick" antenna; commonly used for medium frequency (MF) broadcast reception. The ferrite loopstick usually includes multiple wire turns on a slender ferrite rod, in which permeability greatly exceeds permittivity ($\mu_r >> \in_r$). In this loading, dielectric loading effects are nominal, and controlled wave expansion is not an objective. Specifically, ferrite is configured only inside the winding, where it does not interact directly with the radio waves.

In resistive or dissipative material loading, antennas are configured with lossy materials. For example, an antenna may placed inside an absorber, such as graphite impregnated foam. In resistive loading, radiation efficiency is traded for an increase in VSWR bandwidth. Unfortunately, resistive loading decreases radiation bandwidth and gain.

Prior art material loadings therefore, dielectric, or magnetic, provide antenna miniaturization but at a decrease in instantaneous radiation bandwidth. A broadband approach of antenna loading and miniaturization is needed for wideband communications.

One definition of electrically small involves a spherical envelope of $d<\lambda/2\pi$, where d is the diameter of the sphere, and $\lambda$ is the free space wavelength. An electrically small antenna fits inside this spherical envelope, commonly referred to as a radian sphere.

Radomes can be hollow spherical shells that enclose antennas. They are routinely used for weather protection, and they can provide loading to the antenna. They can be bandwidth limiting, unless they are electrically thin in structure. Thick, strong radomes, commonly operate near even multiples of ½ wavelength thickness, and are bandwidth limited to about ½ octave or less. Thin radomes have more bandwidth, but may be mechanically weak.

The canonical antennas are the line and the circle, which are known in the art as the dipole antenna and the loop antenna. In the dipole antenna, charge is separated, while in the loop, charge is conveyed. Both have been attributed to Hertz. While the line and circle antenna are linearly polarized, when configured together they can provide circular polarization (JASIK et al, "Antenna Engineering Handbook", 1st ed., page 17-9). A vertical dipole and horizontal loop can form a rotationally polarized loop-dipole array, in which the radiating elements have a common centroid and radiation phase center. In the loop-dipole array, the magnetic and electric near fields are balanced and equal.

A more convenient form of the line-circle array is the normal mode helix (WHEELER, H. A.: "A Helical Antenna For Circular Polarization", IRE Proc., vol. 35, December 1947, pp. 1484-1488). The normal mode helix is, so to speak, a hybrid of the inductor loaded dipole and a multiturn loop antenna.

A special form of the normal mode helix is the spherical normal mode helix antenna (SNMHA), which includes a conductive helix wound on a spherical surface. It was first described by Maxwell, as an inductor (MAXWELL, J. E.: "Electricity and Magnetism", Oxford University Press, 3rd edition, Vol 2, 1892, pp. 304-308) and later by Wheeler as an antenna (WHEELER, H. A.: "The Spherical Coil as an Inductor, Shield, or Antenna", IRE Proc., vol. 46, September 1958, pp. 1595-1602 & Errata, vol. 48, March 1960, p. 328)). The Maxwell Inductor—Wheeler Coil holds a special place in electromagnetics. As an antenna, it is equally magnetic and electric, circularly polarized, and electrically small. Unfortunately however, it is narrow in bandwidth.

Other types of common circularly polarized antennas include dipole turnstiles, and crossed loops. Both of which can be electrically small but narrow band.

What is needed then is a small rotationally polarized omnidirectional antenna with increased bandwidth, which may be used for high frequency (HF) applications, portable phones, and other mobile communication systems, for example. Another need is for a broadband antenna loading material that will reduce antenna size and/or a radome shell without limited bandwidth.

SUMMARY OF THE INVENTION

In view of the foregoing background, it is therefore an object of the present invention to provide a small rotationally polarized omnidirectional antenna with increased bandwidth, to provide a broadband loading approach for antenna miniaturization in general, and to provide a broadband radome and shell which is not limited in bandwidth.

This and other objects, features, and advantages in accordance with the present invention are provided by an antenna, which may include a circularly or rotationally polarized antenna element, an inner core, and a isoimpedance ($Z_c \equiv Z_{free\ space}$) magnetodielectric ($\mu_r \equiv \in_r$) layer surrounding the antenna element. The antenna element is preferably spherical, such as a Wheeler Coil or Maxwell Inductor. Also, the isoimpedance magnetodielectric layer preferably defines a magnetodielectric spherical shell or radome.

The isoimpedance magnetodielectric layer may comprise a nickel zinc ferrite of high Curie temperature, or a mixture of magnetic and dielectric materials. Magnetic fractions may include powdered iron or thin film iron flakes. Dielectric fractions may include light metal oxides, or high permittivity piezoelectrics. The layer may also include glass microspheres or foam.

A method aspect includes making an antenna by surrounding a circularly or rotationally polarized antenna element with an isoimpedance magnetodielectric layer.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
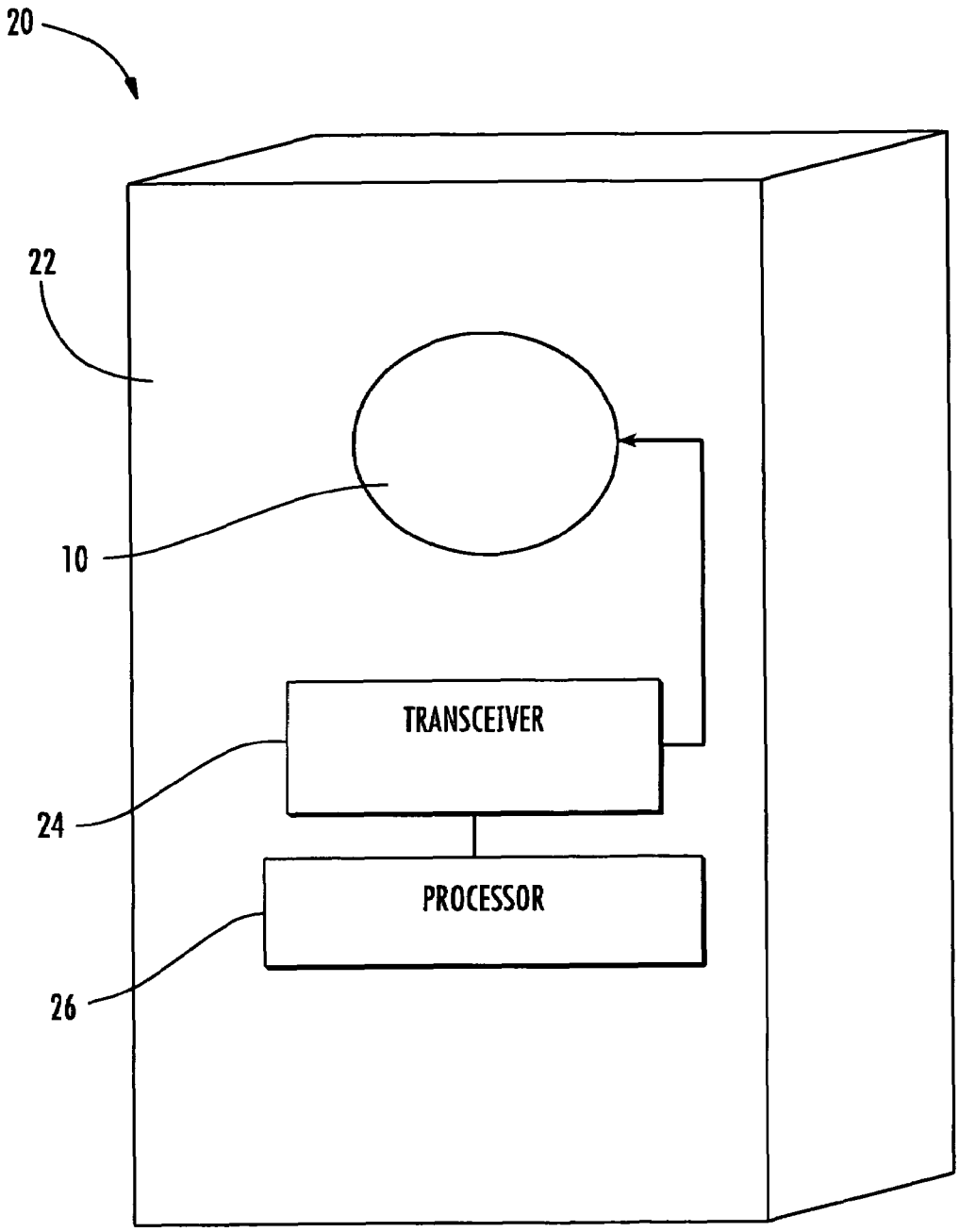
FIG. 1 is a perspective view of a mobile communication device including an antenna according to the present invention.
Figure 2:
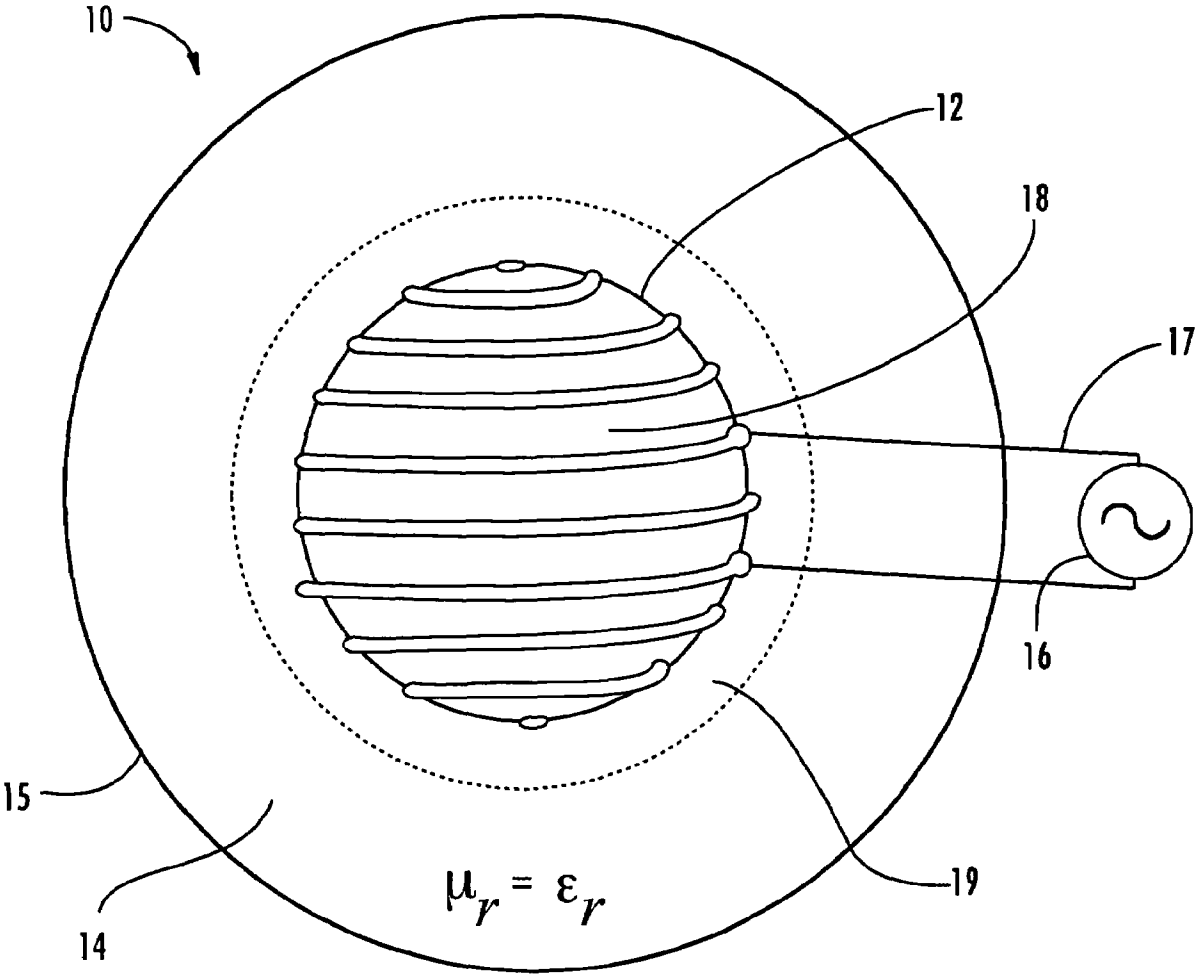
FIG. 2 is a more detailed perspective view of the antenna of FIG. 1 including a circularly polarized antenna element, and a magnetodielectric loading structure surrounding the antenna element, and an inner core.

Referring to FIG. 1, a small circularly polarized omnidirectional antenna 10 with increased bandwidth will now be described. The antenna 10 may be included, for example, in a mobile communications device 20. Such a mobile communications device may be a handheld radio, cell phone or wireless email device including a portable housing 22, a battery (not shown) carried by the portable housing, a transceiver 24 and processor 26 connected to the antenna 10, as would be appreciated by those skilled in the art.

The antenna 10 may be excited, for example, with an excitation source 16 in the mobile communications device 20. A transmission line 17 may be utilized between antenna 10 and the excitation source 16. Such a transmission line may be a coaxial feed, as would be appreciated by the skilled artisan.

Referring to FIG. 1, the radius from the center to an outer spherical surface 15 may preferably be a radiansphere, i.e., $r=\lambda_{air}/(2\pi\sqrt{\in_r\mu_r})$. The antenna 10 includes a rotationally or circularly polarized antenna element 12, and a magnetodielectric layer 14 surrounding the circularly polarized spherical antenna element. As shown, the magnetodielectric layer 14 preferably comprises a magnetodielectric spherical body or shell that extends from adjacent the antenna element 12 to the outer spherical surface 15. Antenna 12 may include a core 18. Optionally, there may be an air space 19 included between antenna 12 and magnetodielectric layer 14. Air space 19 may in practice be air or vacuum, as will be apparent to the skilled artisan.

The antenna element 12 is preferably a circularly polarized spherical antenna element, such as a SNMHA or Maxwell Inductor, as shown. As would be appreciated by those skilled in the art, such an antenna element is electrically small, circularly polarized, and has balanced magnetic and electric near fields.

Core 18, may have a relative permittivity of 4, and a relative permeability of 1, in which case antenna 12, a Maxwell Inductor, becomes a "Wheeler Coil" as would appreciated by those skilled in the art. In general, $\mu_r\in_r=4$ inside circularly polarized Wheeler Coils. The invention is not so limited however, as to Wheeler Coils, and any type of antenna may be configured.

In another embodiment, air space 19 may be omitted, and core material 18 may be magnetodielectric. Core 18 and magnetodielectric layer 14 could form a solid magnetodielectric sphere, providing a high degree of loading effect.

The magnetodielectric layer 14 is almost non-conductive and is a nondispersive medium, i.e. it has a constant time/propagation delay over frequency. The permeability of the material of layer 14 is equal to or substantially equal to the permittivity. That is, $\mu\approx\in$ in layer 14.

The speed of fields and waves in the layer 14, are, in general, much lower than the speed of light. Magnetodielectric layer 14 functions as a media for controlled expansion of near fields into waves. Furthermore, the radio waves, once formed, pass in/out of magnetodielectric layer 14 without reflection, because layer 14 has no reflection coefficient to the surrounding air.

In electromagnetism, permeability is the degree of magnetization of a material that responds linearly to an applied magnetic field. Magnetic permeability is represented by the symbol "μ". The permittivity of a medium is an intensive physical quantity that describes how an electric field affects and is affected by the medium. Permittivity can be looked at as the quality of a material that allows it to store electrical charge. A given amount of material with high permittivity can store more charge than a material with lower permittivity. A high permittivity tends to reduce any electric field present. The permittivity is represented by the symbol "∈".

In electromagnetism one can define an electric displacement field D, which represents how an applied electric field E will influence the organization of electrical charges in the medium, including charge migration and electric dipole reorientation. Its relation to permittivity is given by $D=\in\times E$, where ∈ is a scalar if the medium is isotropic or a 3 by 3 matrix otherwise. Permittivity can take a real or complex value. In general, it is not a constant, as it can vary with the position in the medium, the frequency of the field applied, humidity, temperature, and other parameters.

The permittivity ∈ of a material is usually given relative to that of vacuum, as a relative permittivity, $\in_r$ (also called dielectric constant in some cases). The actual permittivity is then calculated by multiplying the relative permittivity by $\in_0$: $\in=\in_r\in_0$. Opposed to vacuum, the response of real materials to external fields generally depends on the frequency of the field. This frequency dependence reflects the fact that a material's polarization does not respond instantaneously to an applied field. The response must always be causal (arising after the applied field). For this reason permittivity is often treated as a complex function of the frequency of the applied field.

Vacuum permittivity ("the permittivity of free space") is the ratio D/E in vacuum. The permittivity ∈ and magnetic permeability μ of a medium together determine the phase velocity v of electromagnetic radiation through that medium: $\in\mu=1/v^2$.

Figure 3:
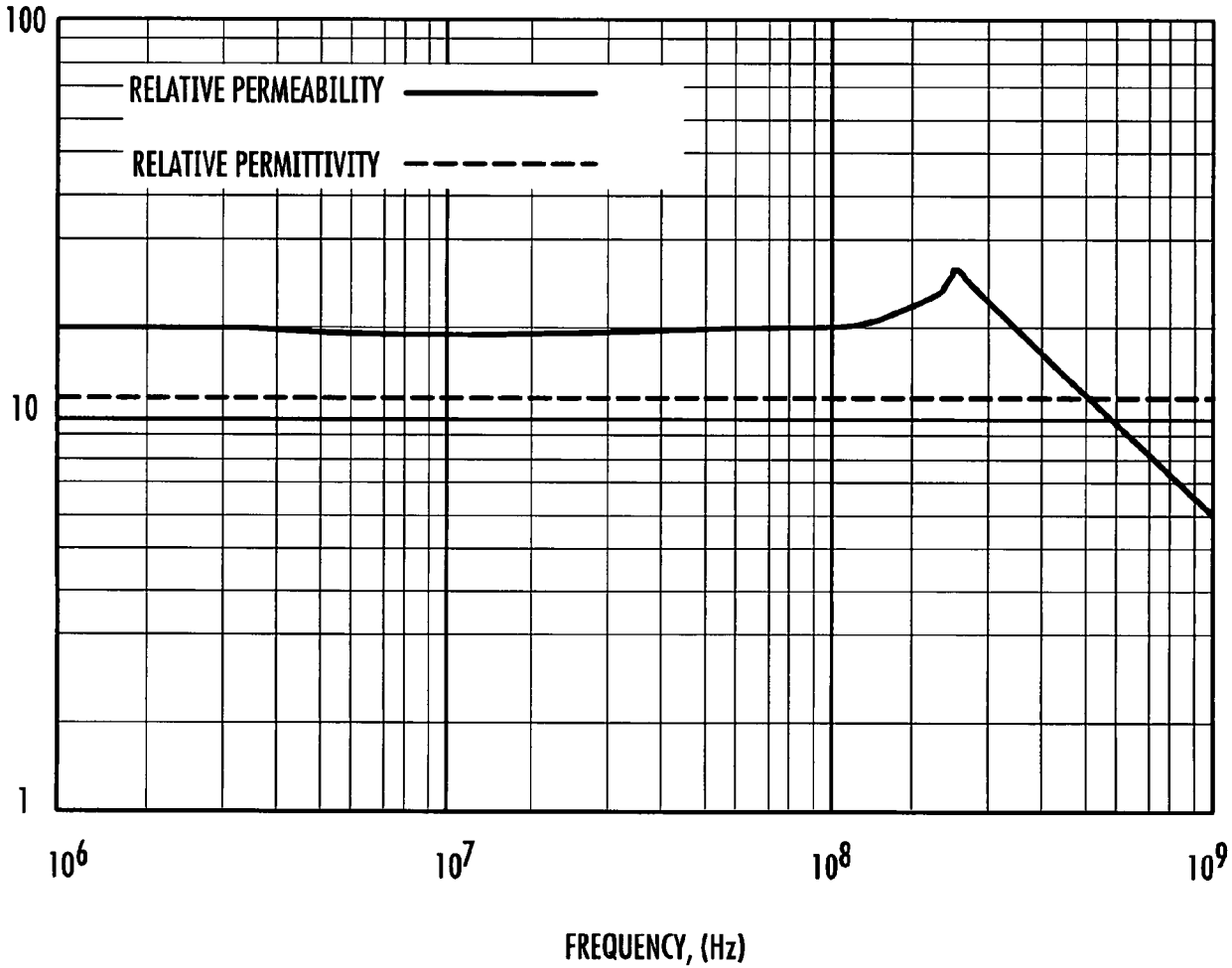
FIG. 3 is a graph of the complex permeability vs. frequency of an example of a representative magnetodielectric loading layer (material 68, a light nickel zinc ferrite) in the antenna of FIG. 1.

The layer 14 is preferably an isoimpedance magnetodielectric material, such as a light nickel zinc ferrite. Representative materials, in current manufacture, are "68 Material", produced by Fair-Rite Products Corp. of Wallkill, N.Y., or "M5", as produced by National Magnetics Group of Bethlehem, Pa. The relative permeability, and relative permittivity, vs. frequency, of Material 68 are shown in the graph of FIG. 3. These, and other high Curie temperature ferrites, can have characteristic wave impedances approximately matched to free space. The diameter of the sphere defining layer 14 may, for example, be 1/51 of the in-air wavelength for Material 68, and forming a radiansphere.

The wave and loading properties of Material 68 are summarized in the following table:

| Light Nickel Zinc (High Curie Temperature) Ferrite | |
|---|---|
| Permeability | 20 |
| Permittivity | ~13 |
| Wave Impedance | 467 Ohms |
| Propagation Velocity | 0.06 C |
| Reflection Coefficient to air medium/ free space | 0.106 (−9.7 as dB) |
| Wave VSWR at air interface | 1.9 to 1 |
| Antenna loading factor | 17X |

Alternatively, layer 14 may be a mixture of materials, magnetic and dielectric, to form magnetodielectric. Suitable RF permeables, or ferromagnetic materials, include pentacarbonyl E iron powder, iron oxide, thin film iron flakes, sintered heavy ferrite or magnetite. These may be used in mixture, with dielectrics, such as glass microspheres and/or styrene foams, or high-k dielectrics, such as piezoelectrics. A method, according to present invention, is to proportion the mixture according to logarithmic mixing approaches such that $(\mu_r \equiv \in_r) >> 1$.

Equal magnetic and dielectric isoimpedance magnetodielectric loading offers a size reduction without a reduction in bandwidth. This is because the E and H field expansion occurs equally in isoimpedance magnetodielectric material, both electric and magnetic. Inside the magnetodielectric sphere, the speed of light is slowed, loading and miniaturizing the antenna. The antennas waves, once formed, pass between isoimpedance magnetodielectric and free space without reflection.

In practice, binary loading can offer greater size reduction than unary loading. For instance, loading effect is related to wave velocity in the loading material:

$$v = c/\sqrt{\mu_r \in_r}$$

where:

v=wave velocity in loading material c=speed of light $\mu_r$=permeability $\in_r$=Permittivity In binary loading, both permittivity and permeability contribute to antenna size reduction. The dielectric property ($\in'$) of ferrite, is typically 12 or 13.

A method aspect includes making an antenna 10 comprising providing a circularly or rotationally polarized antenna element 12, and surrounding the antenna element with an isoimpedance magnetodielectric layer 14, for example, dimensioned as:

$$d = 2(\lambda/2\pi)[1/(\mu_r \in_r)^{1/2}]$$

$$(\mu_r \equiv \in_r) >> 1$$

where, d=diameter of isoimpedance magnetodielectric loading sphere, magnetodielectric layer 14

λ=free space wavelength $\mu_r$=relative permeability $\in_r$=relative permittivity Thus, the magnetodielectric loading sphere is also a radiansphere, extending from the antenna phase center to the region of wave formation. Further details of a radiansphere may be found in WHEELER, H. A. "The Radiansphere Around A Small Antenna", Proceedings of the IRE, August 1959, which is herein incorporated by reference. The transition between reactive near fields and radiated far fields in small antennas occurs radially at $\lambda/2\pi$.

Although the above description refers to circular polarization, the present invention is not so however limited. Magnetodielectric layer 14, may be used, for example, over linearly polarized antennas such as thin wire dipoles. A circularly polarized antenna takes full advantage of binary loading though, as the near field properties of circularly polarized antennas are balanced. Air space 18 may be relatively larger for linearly polarized antenna elements.

Magnetodielectric layer 14 operates with an infinite passband or bandwidth, as the magnetodielectric material offers a perfect reflectionless boundary to free space. This is the because the wave impedance in magnetodielectric layer 14 is the same as free space, since, $$Z_c = E/H = 120\pi\sqrt{(\mu_r/\in_r)}$$

Free Space: $\mu_r = 1$ $\in_r = 1$ $$Z_{free\ space} = 120\pi\sqrt{(1/1)} = 120\pi$$

Magnetodielectric Layer 14: $\mu_r = \in_r$, so $(\mu_r/\in_r) = 1$ since $\mu_r \equiv \in_r$ $$Z_{14} = 120\pi\sqrt{(1)} = 120\pi$$

So $Z_{free\ space} = Z_{14}$ and $$\Gamma = (Z_{free\ space} - Z_{14})/(Z_{free\ space} + Z_{14}) = (120\pi - 120\pi)/(120\pi + 120\pi) = 0/240\pi = 0$$

For loading effect, magnetodielectric layer 14 is brought within the reactive near fields of the enclosed antenna, by reducing or eliminating air space 19. For no loading effect, magnetodielectric layer 14 is spaced away from the enclosed antennas reactive near fields, by making air space 19 large. Thus, magnetodielectric layer 14 can function as a radome with or without loading effect. Magnetodielectric layer 14 can, in one embodiment, simply be a radome shell of infinite passband bandwidth.

Alternatively, magnetodielectric layer 14 may be hemispherical and the antenna operated against a conductive ground plane, in the usual image equivalent manner. Thus, antenna 10 becomes a magnetodielectric "chip antenna", suitable for use as a circuit board component.

Although Isoimpedance Materials are reflectionless to free space, they are refractive to free space, since $\mu_r \in_r \neq 1$ to avoid refraction. The simultaneous conditions $\mu_r \in_r \neq 1$ and $\mu_r \in_r$, nonreflection and nonrefraction, can only occur for $\mu_r = 1$ and $\in_r = 1$. It is preferred therefore that the phase center and centroid of radiation of antenna 10 be coincident with the centroid of magnetodielectric layer 14, as refraction can modify radiation pattern shape.

In the present understanding, it appears that internally reflected waves cannot form inside magnetodielectric layer 14. Externally applied waves can however form surface waves over magnetodielectric layer 14.

The degree of physical size reduction or electrical size enhancement may in the present invention be cubic, since from Chu's relation bandwidth is inversely related to size, as $Q=1/kr^3$.

Slot antennas, in metal sheets, can involve a difficult trade between bandwidth and cavity size. Core material 18 may be a magnetodielectric loading fill for cavities that back slot antennas, and magnetodielectric layer 14 may be an external layer over the antenna slot. TEM mode cavities, for slot antennas, may take the form of microstrip transmission lines. Slot antennas may be familiar to those skilled in the art as microstrip patch antennas. Core material 18 may therefore be a substrate for microstrip patch antennas.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

The invention claimed is:

1. An antenna comprising:

a polarized antenna element; and an isoimpedance magnetodielectric layer surrounding the polarized antenna element on all sides.

2. The antenna according to claim 1, wherein the polarized antenna element comprises a circularly polarized spherical antenna element.

3. The antenna according to claim 2, wherein the circularly polarized spherical antenna element comprises a Wheeler coil.

4. The antenna according to claim 1, wherein the isoimpedance magnetodielectric layer comprises a magnetodielectric spherical body.

5. The antenna according to claim 1, wherein the isoimpedance magnetodielectric layer comprises a ferromagnetic material.

6. The antenna according to claim 1, wherein the isoimpedance magnetodielectric layer comprises an iron oxide.

7. The antenna according to claim 1, wherein the isoimpedance magnetodielectric layer comprises light nickel zinc ferrite.

8. The antenna according to claim 1, wherein the isoimpedance magnetodielectric layer comprises magnetite.

9. The antenna according to claim 1, wherein the isoimpedance magnetodielectric layer comprises:

at least one of glass microspheres and styrene foams;

at least one off powdered iron and thin film iron flakes; and at least one high-k dielectric.

10. An antenna comprising:

a circularly polarized spherical antenna element;

an isoimpedance magnetodielectric spherical body surrounding the circularly polarized spherical antenna element; and an antenna feed structure connected to the circularly polarized spherical antenna element.

11. The antenna according to claim 10, wherein the circularly polarized spherical antenna element comprises a Wheeler coil.

12. The antenna according to claim 10, wherein the isoimpedance magnetodielectric sphere comprises a ferromagnetic material.

13. The antenna according to claim 10, wherein the isoimpedance magnetodielectric sphere comprises:

at least one of glass microspheres and styrene foams;

at least one of powdered iron and thin film iron flakes; and at least one high-k dielectric.

14. A method of making an antenna comprising:

providing a rotationally polarized antenna element; and surrounding the rotationally polarized antenna element on all sides with an isoimpedance magnetodielectric layer.

15. The method according to claim 14, wherein providing the rotationally polarized antenna element comprises providing a circularly polarized spherical antenna element.

16. The method according to claim 15, wherein providing the circularly polarized spherical antenna element comprises providing a Wheeler coil.

17. The method according to claim 14, wherein surrounding comprises surrounding the rotationally polarized antenna element with an isoimpedance magnetodielectric spherical body.

18. The method according to claim 14, wherein surrounding comprises surrounding the rotationally polarized antenna element with a ferrimagnetic material.

19. The method according to claim 14, wherein surrounding comprises surrounding the rotationally polarized antenna element with an iron oxide.

20. The method according to claim 14, wherein surrounding comprises surrounding the rotationally polarized antenna element with light nickel zinc ferrite.

21. The method according to claim 14, wherein surrounding comprises surrounding the rotationally polarized antenna element with magnetite.

22. The method according to claim 14, wherein surrounding comprises surrounding the rotationally polarized antenna element with:

at least one of glass microspheres and styrene foams;

at least one of powdered iron and thin film iron flakes; and at least one high-k dielectric.

23. An antenna comprising:

a circularly polarized spherical antenna element; and an isoimpedance magnetodielectric layer surrounding the circularly polarized spherical antenna element.

24. The antenna according to claim 23, wherein the circularly polarized spherical antenna element comprises a Wheeler coil.

25. The antenna according to claim 23, wherein the isoimpedance magnetodielectric layer comprises a magnetodielectric spherical body.

26. The antenna according to claim 23, wherein the isoimpedance magnetodielectric layer comprises at least one of a ferromagnetic material, an iron oxide, a light nickel zinc ferrite, and magnetite.

27. An antenna comprising:

a polarized antenna element; and a magnetodielectric layer surrounding the polarized antenna element and comprising, at least one of glass microspheres and styrene foams, at least one of powdered iron and thin film iron flakes, and at least one high-k dielectric.

28. The antenna according to claim 27, wherein the magnetodielectric layer comprises a magnetodielectric spherical body.

29. The antenna according to claim 27, wherein the magnetodielectric layer comprises at least one of a ferromagnetic material, an iron oxide, a light nickel zinc ferrite, and magnetite.

* * * * *